United States Patent [19]

Haskell

[11] Patent Number: 4,613,715

[45] Date of Patent: Sep. 23, 1986

[54] OXYGEN ADDITION TO A STEAM-ACTIVE DEHYDROGENATION REACTOR

[75] Inventor: Donald M. Haskell, Bartlesville, Okla.

[73] Assignee: Phillips Petroleum Company, Bartlesville, Okla.

[21] Appl. No.: 754,313

[22] Filed: Jul. 12, 1985

[51] Int. Cl.[4] ..... C07C 2/82

[52] U.S. Cl. ..... 585/412; 585/415; 585/417; 585/419; 585/441; 585/443

[58] Field of Search ..... 585/410, 412, 415, 417, 585/419, 441, 443

[56] References Cited

U.S. PATENT DOCUMENTS

| | | | |
|---|---|---|---|
| 2,598,642 | 5/1952 | Hurley | 585/414 |
| 2,856,441 | 10/1958 | Murray | 585/414 |
| 2,900,427 | 8/1959 | Viles | 585/412 |
| 3,033,906 | 5/1962 | Hay et al. | 585/412 |
| 3,161,670 | 12/1964 | Adams et al. | 585/320 |
| 3,270,080 | 8/1966 | Christmann | 585/622 |
| 3,303,234 | 2/1967 | Bajars et al. | 585/618 |
| 3,303,235 | 2/1967 | Croce et al. | 585/618 |
| 3,303,236 | 2/1967 | Croce et al. | 585/618 |
| 3,303,237 | 2/1967 | Croce et al. | 585/621 |
| 3,303,238 | 2/1967 | Christmann | 585/625 |
| 3,308,182 | 3/1967 | Gabliks et al. | 585/618 |
| 3,324,195 | 6/1967 | Hwa et al. | 585/621 |
| 3,334,152 | 8/1967 | Bajars et al. | 585/625 |
| 3,340,321 | 9/1967 | Craig | 585/501 |
| 3,342,890 | 9/1967 | Croce et al. | 585/625 |
| 3,398,100 | 8/1968 | Christmann | 502/213 |
| 3,461,177 | 8/1969 | Box et al. | 585/419 |
| 3,513,215 | 5/1970 | Ogle | 585/621 |
| 3,548,021 | 12/1970 | Brattesani | 585/414 |
| 3,670,044 | 6/1972 | Drehman et al. | 585/415 |
| 3,751,385 | 8/1973 | Manning | 585/418 |
| 3,851,008 | 11/1974 | Stowe et al. | 585/622 |
| 3,880,776 | 4/1975 | Box et al. | 585/415 |
| 3,894,110 | 7/1975 | Drehman | 585/660 |
| 3,925,498 | 12/1975 | Stadig | 585/625 |
| 4,021,500 | 5/1977 | Rogers | 585/623 |
| 4,046,833 | 9/1977 | Hardman | 585/658 |
| 4,079,017 | 4/1978 | Crawford et al. | 252/373 |
| 4,167,472 | 9/1979 | Dick et al. | 585/419 |
| 4,206,035 | 6/1980 | Hutson et al. | 585/419 |
| 4,247,530 | 1/1981 | Cheng et al. | 423/450 |
| 4,327,238 | 4/1982 | Eastman | 585/661 |

*Primary Examiner*—Asok Pal

*Attorney, Agent, or Firm*—K. K. Brandes

[57] ABSTRACT

In a process for dehydrocyclization of $C_6$-$C_{12}$ alkanes in the presence of steam and a bed of a catalyst containing a Group IIA or IIB metal aluminate and a Group VIII metal, an oxygen containing gas is injected into the catalyst bed. The results of the oxygen injection are the internal generation of heat, a lower required steam to hydrocarbon ratio, and increased yield of aromatics.

20 Claims, 1 Drawing Figure

OXYGEN ADDITION TO A STEAM-ACTIVE DEHYDROGENATION REACTOR

This invention relates to an improved process for the catalytic dehydrocylization of dehydrocyclizable hydrocarbons.

BACKGROUND OF THE INVENTION

Production of $C_6$–$C_9$ aromatics is important to the chemical and petroleum industries. These aromatics improve the octane number of lead-free motor fuel. Dehydrocyclization is an attractive process for upgrading low octane refinery streams to high octane lead-free motor fuel blend stocks. It may also be used to increase the supply of aromatics for producing various petrochemical intermediates. For example, benzene and toluene are used in the manufacture of other aromatic compounds such as chlorobenzene, trinitrotoluene and styrene. These aromatics can be produced from paraffins and/or cycloparaffins by catalytic reforming at relatively high temperatures e.g., above about 950 F., in the presence of hydrogen and steam. A known process for the catalytic dehydrogenation and dehydrocyclization of various alkanes diluted with steam and in the absence of free oxygen is disclosed by Box, et al in U.S. Pat. No. 3,461,177 (1969). In U.S. Pat. No. 3,670,044 (1972) Drehman et al disclose that certain alkanes diluted with steam can be subjected to catalytic dehydrogenation in the presence of gaseous hydrogen or mixtures of gaseous hydrogen and gaseous oxygen.

The dehydrogenation and cyclization reactions which result in the formation of $C_6$ to $C_9$ aromatics are highly endothermic. Conventionally, the heat required to maintain the reaction temperature is supplied by steam mixed with the feed and by interstage heaters. Generally a high mole ratio of steam to hydrocarbon feed, e.g., about 10/1 to 15/1, is required to obtain high conversion rates and selectivity to aromatics. Since usually fuels are burned to supply the energy for generating steam, it is desirable to develop a process which requires relatively less steam, and therefore less combustion of additional fuel.

SUMMARY OF THE INVENTION

An object of this invention is to provide a process for the catalytic dehydrocyclization of various alkanes which requires less steam as a heat source and thus requires less combustion of fuel external to the reactors. Another object of this invention is to provide means for internally generating the heat required for the endothermic dehydrocyclization reaction. Still another object is to provide a dehydrocyclization process of higher efficiency and higher aromatics yields. Another object of this invention is to keep a substantial amount of a zinc aluminate catalyst used in a reforming process hot enough to be active.

Other objects and advantages of this invention will be apparent from the disclosure, the drawing, and the appended claims.

In accordance with this invention it has been found that by injecting free oxygen into a catalytic dehydrocyclization unit downstream of the entry of the feed materials, improved efficiency of such a process is achieved. In accordance with one embodiment of this invention, a process for dehydrocyclization of hydrocarbons comprises the steps of contacting a feed stream, which comprises steam and at least one hydrocarbon selected from the group of normal alkanes and isoalkanes containing from 6 to 12 carbon atoms per molecule, with at least one bed of dehydrogenation catalyst comprising at least one Group VIII metal and at least one support material selected from the group consisting of Group IIA and Group IIB metal aluminate spinels thus forming a reaction mixture and heating said reaction mixture under such conditions as to produce aromatic hydrocarbons having from 6 to 12 carbon atoms per molecule, wherein a gas containing free oxygen, preferably oxygen or air, is injected into the catalyst bed at one or more points downstream of the point where the feed stream is first contacted with said catalyst bed. This injection of oxygen generates heat by combustion of a portion of the hydrocarbons and/or a portion of hydrogen and/or coke formed in the process and directly supplies heat required for the endothermic dehydrocyclization reaction, and also increases the amount of formed aromatics.

Further in accordance with this invention, paraffinic or synthetic naphthas (e.g., raffinates) are catalytically converted to aromatics by the steam-active dehydrocyclization process of this invention wherein oxygen or air is injected into one or more reactors and/or interstage combustion chambers at one or more points to generate heat by combustion of a portion of the hydrocarbons and/or hydrogen and/or coke in the presence of a dehydrocyclization catalyst, preferably a platinum-tin catalyst supported on zinc aluminate.

BIREF DESCRIPTION OF THE DRAWING

FIG. 1 is a schematic flow diagram depicting the invention.

DETAILED DESCRIPTION OF THE INVENTION

Applicable Feeds

Figure 1:
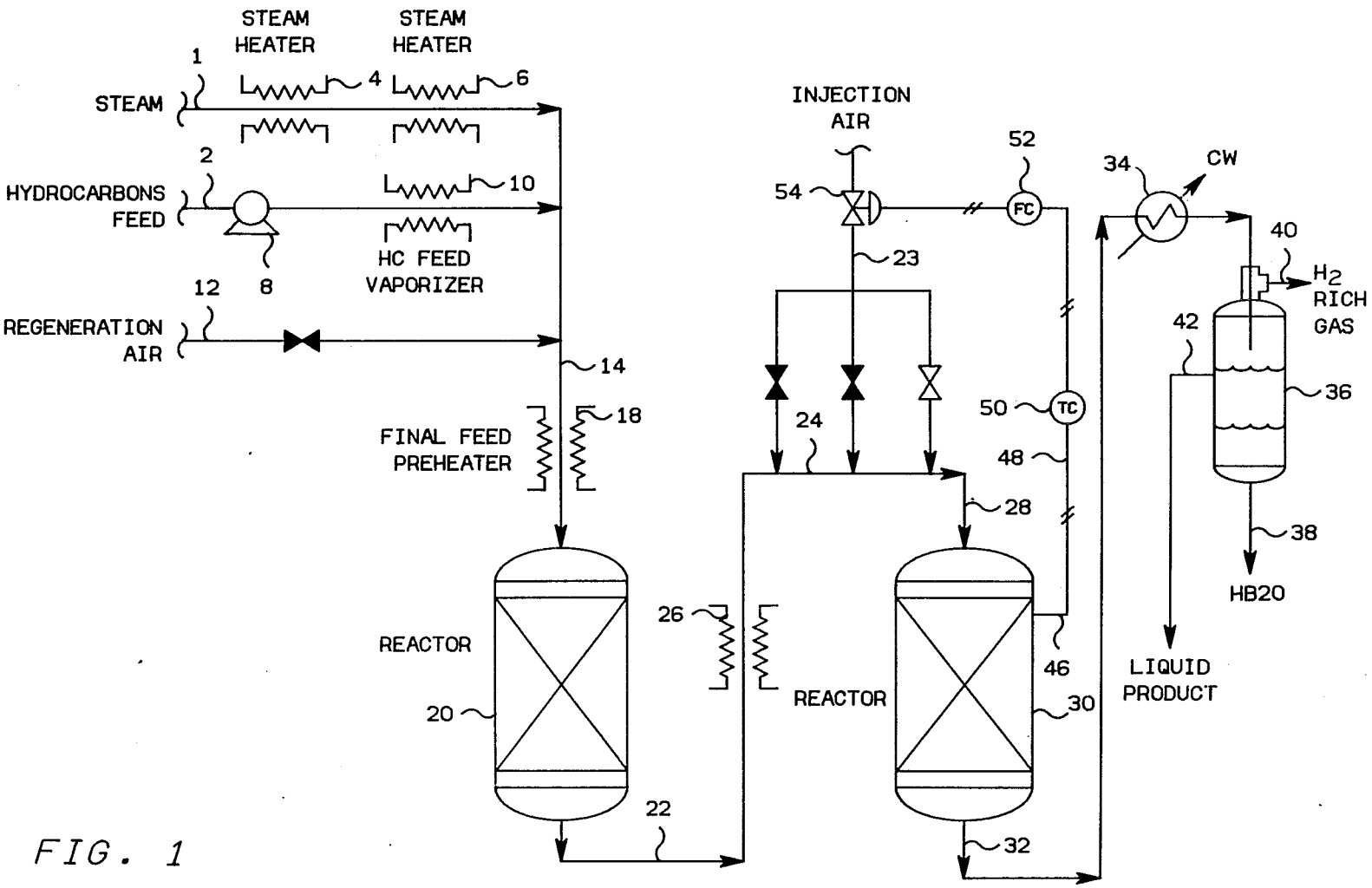

Suitable paraffinic hydrocarbon feeds hereinafter referred to simply as "feed", for the present invention range from pure paraffins to naphthas and raffinate gasoline streams containing natural or synthetic hydrocarbons. Thus the feed can comprise hydrocarbons selected from the group consisting of alkanes, isoalkanes, and mixtures thereof. Normal alkanes and isoalkanes having from 6 to about 12 carbon atoms are preferred feedstocks. Normal paraffins and isoparaffins containing from 6 to 9 carbon atoms per molecule are particularly applicable. Specific examples of feed materials are n-hexane, n-heptane, n-octane, n-nonane, isohexanes, isoheptanes and naphtha streams containing these paraffins. Typically, up to about 5 percent aromatics, such as benzene, toluene, xylene, and ethylbenzene, may be contained in the feeds. Higher concentrations of aromatics present no problems; however, they act as inerts in the process.

Applicable Catalysts

Suitable catalysts can be prepared by combining, in any manner known in the art, certain Group VIII metals or metal compounds capable of reduction, including nickel, platinum, ruthenium, palladium, iridium, rhodium, osmium, and mixtures thereof, with a carrier selected from the group consisting of Group IIA metal aluminate spinels (i.e., aluminate spinels of alkaline earth metals), Group IIB metal aluminate spinels (i.e., aluminate spinels of cadmium and zinc) and mixtures thereof, including mixtures of spinel and excess Group IIA or IIB metal oxide or spinel and excess alumina. Aluminate spinels, as referred to herein, are compounds of the formula $M(AlO_2)_2$ or $MOAl_2O_3$, wherein M is a Group IIa or IIb of the Periodic Table with a valence of 2 such as Zn, Mg, Be, Ca and the like. Optionally a Group IVA metal such as germanium, lead or tin can also be present in the catalyst. The resulting composite can be treated by any means known to the art with at least one alkali or alkaline earth metal compound, such as sodium hydroxide, potassium carbonate, lithium hydroxide, barium acetate, barium hydroxide, calcium oxide, and the like, so as to impart to the resulting composite an alkaline pH of at least 8. A presently preferred catalyst suitable for the steam-active dehydrocyclization of the presnet invention is zinc aluminate spinel promoted with platinum and, optionally, tin or cesium, as disclosed in U.S. Pat. No. 3,670,044 herein incorporated by reference. A particularly preferred catalyst for reforming paraffins and naphthenes to aromatics is zinc aluminate spinel containing 0.1 to 2 weight percent tin (generally as $SnO_2$) and further impregnated with varying amounts of platinum, generally from about 0.1 to 5 weight percent Pt (weight percentages are based on the weight of the entire catalyst).

The preferred spinel base is prepared by ball milling appropriate amounts of oxides of zinc, aluminum, and tin oxides and calcining under sufficiently severe conditions to form the spinel.

Typical properties of the zinc aluminate are:

| | |
|---|---|
| ZnO | 48.5 wt. % |
| $Al_2O_3$ | 50.6 wt. % |
| $SnO_2$ | 1.3 wt. % |
| Surface area | 12.0 $m^2/g$ |
| Pore volume | 0.33 cc/g |
| Avg. pore diameter | 1100 A |
| Bulk Density | 0.96 g/cc |

DETAILED DESCRIPTION OF THE DRAWING

Any conventional catalytic reforming apparatus made of materials such as stainless steel may be used to efficiently convert liquid or vaporous paraffinic streams to aromatics according to this invention. A nonlimiting example is provided in FIG. 1, a schematic flow diagram of a steam-active reforming operation carried out in the pilot plant.

Steam stream 1, generated from water treated with an ion-exchange resin (not shown), was charged through a series of two electric steam heaters 4 and 6. Feed stream 2, primarily paraffinic or synthetic naphthas, was transferred from a pressurized tank (not shown) to feed vaporizer 10, with the feed rate controlled by a Taylor Flow controller and motor valve (not shown). Alternatively, the feed could be charged by pump 8, such as a Lapp "Microflo Pulsafeeder" or a Milton Roy "minipump" proportionating pump. The mixed stream 14 of said steam and feed was passed through a final feed preheater 18 prior to entering the first catalytic reactor 20, having a nominal volume of 10 to 32 cubic inches, with the temperature of the stream maintained at the desired level by built-in interstage heaters as an alternative to air injection.

Reactor effluent 22 was passed through an interstage combustion chamber to react with an air steam 23 injected at a variable point 24 between the first and second reactors to generate the heat required for the endothermic dehydrocyclization reaction of the feed hydrocarbons by combustion of a part of the hydrocarbons and hydrogen, as well as coke when present, with the air. The flow rate of air stream 23 is controlled by a temperature control-flow control loop described later. Conventional heating equipment such as interstage heater 26 is thus rendered unnecessary or can be reduced in size. Some hydrogen will be generated by the dehydrogenation and dehydrocyclization reactions, and can be combusted with oxygen to generate heat. Hydrogen can also be added with the feed to reduce catalyst fouling and will serve the same purpose, but this is not required to practice the invention. The thus heated stream 28 was fed into the second catalytic reactor 30 which was identical to the first reactor 20, also having a catalyst bed for further product conversion. The effluent 32 from reactor 30 was condensed in a cooler 34 and passed to a separator tank 36 from which streams of liquid water 38 and liquid product 42 were withdrawn at suitable intervals. The respective weights and volumes of these streams were measured and recorded. The gaseous effluent stream 40 from the separation tank 36 was vented after passing through a drier bottle, a carbon dioxide absorber, and another drier bottle (not shown).

During the dehydrocyclization operation, the catalyst, which can be in any suitable form such as granules, pills, pellets, spheres, and the like, will slowly lose some activity and will periodically require regeneration by conventional means. This can be conveniently accomplished by cutting off the feed and treating the catalyst with steam-diluted air 12, such that the oxygen content of the mixture is about 1–2 mole percent. The regeneration treatment can be carried out at temperatures and pressures within the dehydrocyclization operating range for about 15 minutes to 1 hour.

With a two-reactor system as shown in FIG. 1, the invention is practiced by injecting air or other gases containing free oxygen into the line or combustion chamber between the two reactors at a variable point 24 at least half way between said reactors, and preferably about two-thirds of the distance between said reactors. Air may also be injected at points located about one-half to two-thirds of the way down reactor 20 to produce higher tempratures and higher conversion in the lower part of this reactor, as well as between reactor 20 and reactor 30; and in reactor 30 as well to reduce the temperature gradient.

Generally oxygen can be injected in any location where needed to restore the feed mixture to the desired reaction temperature and in any desired amount within the local and total limits disclosed above. Assuming that the feed mixture is preheated prior to entering the reactor, oxygen should be injected at points downstream where the temperature has dropped significantly e.g., as much as about 50–70 F. degrees. Oxygen can be injected into each reactor and/or between reactor stages. Also, an extended, continuous reactor can be used rather than discrete stages, and oxygen can be injected at the points needed. The temperature can be controlled in a range as close as practicable to the preferred reaction temperature for the feed and catalyst used. For example, with the catalyst described herein, the dehydrocyclization of naphtha takes place between about 900 and 1100 F. Below about 900 F. the reaction rate is rather slow, while above 1100 F., thermal cracking to undesirable products such as light gases and coke becomes significant. Thus, it is preferable to maintain the entire catalyst bed in the temperature range of from about 900 F. to about 1100 F., or more preferably, from about 1000 F. to about 1100 F.

Any gas containing free oxygen can be injected into the reactor system in accordance with this invention, provided the gases other than oxygen are inert to the hydrocarbons in the feed and to the dehydrocyclization reaction. Such inert gases will of course act as a diluent. Since air is cheaply and readily available and provides oxygen in a safe concentration, it is generally preferred. While the amount of oxygen-containing gas injected is conveniently measured in terms of moles or volumes per mole or volume of hydrocarbon feed, the factor determining effectiveness is the number of moles of free oxygen introduced per mole of hydrocarbon feed. Total amounts of oxygen in the range from about 20 to about 500 moles per 100 moles of hydrocarbons can be used, depending upon the type of feed used and the type and condition of the catalyst. Since air is the preferred gas for the injection of oxygen, these numbers can be multiplied by 5 to estimate the equivalent moles of air. Preferred oxygen ranges are from about 40 to about 200 moles of $O_2$ per 100 moles hydrocarbons. Preferably, an amount of oxygen is added which will maintain the reactors at optimum operating temperature to produce the maximum total yield of aromatics with a minimum consumption of fuel for interstage heaters and of steam, but without allowing the reactor system to overheat. Multiple injection points are preferred, since they permit the use of higher total oxygen ratios without local excesses. Depending upon the base reactor temperature and other conditions, when amounts of oxygen in the range of from about 40 to about 60 moles oxygen per 100 moles hydrocarbons are injected in one location, overheating of the catalyst and non-selective conversion of the feed to coke and light gases can occur. Excessive use above this limit could cause overheating in the reactor and result in an undesirable run-away reaction or damage to the catalyst. Care should also be taken to keep the resulting local mixtures of oxygen, hydrocarbons, hydrogen and inert gases safely outside the explosive limits.

The oxygen-containing gas should be introduced at a point in the reactor system where it will react with the feed hydrocarbons and/or coke and hydrogen to liberate heat which will maintain the reactor system at an appropriate temperature. For a two-reactor system as depicted in FIG. 1 and the examples, the oxygen-containing gas can be injected at one or more points at any point beyond the first half of the first reactor. Generally, best results are obtained by injecting the gas at points within a range of from about one-half to about two-thirds along the longitudinal axis of said first reactor, as well as between reactors and at one or more intermediate points in the second reactor.

The amount of the oxygen-containing gas introduced can be controlled by various conventional control means. An exemplary control system provides a temperature sensor for measuring the reactor bed temperature in the second reactor 30, preferably at a point 46 near the reactor inlet. A temperature control means 50 is operable for receiving a temperature measurement signal via line 48. The temperature controller transmits a signal to flow controller 52, which activates valve 54 in response to the difference between a desired setpoint temperature and said measured temperature. An increase in temperature above the set point will generally require that the flow of air be reduced. The flow of steam can be controlled separately, depending upon conditions and the amounts needed to prevent coking and to provide the initial heat to the reaction mixture. The efficiency of the system can be greatly improved by sensing temperatures in multiple points in the reactor(s) and/or interstage combustion chamber and controlling the injection of oxygen at multiple points in response.

TYPICAL STEAM-ACTIVE REFORMING CONDITIONS

Since the total amounts of oxygen, steam and, optionally, hydrogen, can be varied independently, various combinations of flow rates can be used effectively for dehydrocyclization of the hydrocarbon feeds disclosed with the catalysts disclosed. Broadly, free oxygen can be injected downstream of the feed entry in amounts in the range of from about 20 to about 500 moles, hydrogen gas in amounts in the range of from about 0 to about 200 moles (preferably from about 50–200 moles), and steam in amounts in the range of from about 200 to about 1000 moles, all on the basis of 100 moles hydrocarbon feed. Preferred combinations of these injection proportions, which can also be expressed as feed rates, are tabulated below.

| | Moles of $O_2$, $H_2$ and Steam per 100 Moles Hydrocarbon Feed | | |
|---|---|---|---|
| | Generally | Preferred | Most Preferred |
| $O_2$ | 20–500 | 40–200 | 40–100 |
| $H_2$ | 0–200 | 50–200 | 100–200 |
| Steam | 200–1000 | 300–1000 | 500–1000 |

The invention will be further illustrated by the following non-limiting examples:

CALCULATED EXAMPLE I

The following example of a dehydrocyclization process using injected steam, hydrogen and air illustrates that good yields of aromatic-rich liquid product can be obtained using the invention.

In a typical pilot plant operation about 0.5 gal/hr. of paraffinic feed at 80 F. is pumped to a vaporizer to be vaporized at 700 F. After being mixed with a 10 SCFH hydrogen stream, the mixture enters the process furnace to be heated to 900 F. The mixture is further mixed with superheated steam at 50 psig to reach 1300 F. at a steam/feed mole ratio of 8/1. The combined mixture enters the first reactor at 1120 F. for a residence time of 0.3 seconds in the presence of platinum-tin (about 0.60 percent Pt; 1.0 percent tin) catalyst deposited on a zinc aluminate spinel support at a hydrocarbon feed rate of 4.1 (hours$^{-1}$) liquid hourly space velocity (LHSV). The catalyst volume is 22 cubic inches per reactor. Only about 40 percent of the dehydrocyclization reaction occurs in this reactor. The stream containing unreacted feed and product exits from the first reactor at about 900–930 F. and enters an interstage chamber to be heated to 1120 F. by direct combustion of injected air and hydrocarbon. The local air/feed mole ratio is 0.65:1. The stream enters the second reactor to react for the same residence time as in the first reactor, in the presence of the same type catalyst (same composition as in the first reactor) at a feed rate of 4.1 (hours$^{-1}$) LHSV. The effluent leaves the second reactor at about 900–930 F., and is then cooled to about 500 F. This 500 F. effluent is then passed to a hydrogenation reactor to eliminate diolefins, which would tend to cause gumming in a motor fuel. The effluent from this reactor is condensed at about 80 F. About 78.5 percent of the feed (which contained about 1.6 wt. percent aromtics), is recovered as liquid product containing about 48 wt. percent aromatics. Further examples showing the effect of no air and increasing amounts of air are given below.

EXAMPLE I

Effectiveness of Air Injection to Promote Conversion

Referring again to FIG. 1, the pilot plant consisted of two adiabatic fixed-bed reactors in series. Each reactor was 2 inches in diameter by 9 inches long and packed with 7 inches of catalyst, a zinc aluminate spinel impregnated with 0.1 to 2 weight percent tin and 0.1 to 5 weight percent platinum.

Shown in the list below are ranges of conditions which were employed in various runs with the pilot plant.

| | |
|---|---|
| Temperature in the 1st reactor, F.: | In - 1080–1120; Out - 906–929 |
| Temperature in the second reactor, F.: | In - 910–1120; Out - 907–975 |
| Pressure in the first reactor, psig: | 51–70 |
| Pressure out, second reactor, psig: | 50–70 |
| Hydrocarbon feed rate, LHSV: | 1.0–2.5 |
| Steam feed rate: | 7.6–8.2 moles/mol hydrocarbon feed |
| Hydrogen feed rate: | 0.49–0.5 moles/mol hydrocarbon feed |
| Air injection rate: | 0–0.75 moles/mole hydrocarbon feed |

The feedstream, consisting of 7.5 to 8.2 mols of steam and 0.49 mols of hydrogen per mol of naphtha feed, was preheated to 1120 F. in heaters 4 and 6 and then introduced into reactor 20. The reaction taking place over the catalyst was endothermic, causing the temperature of the process stream to drop to about 911 to 929 F. The reaction essentially stopped at this temperature, hence there was no driving force to lower the temperature further. At this point the effluent from reactor 20 was either introduced directly into reactor 30 without reheating, or reheated in an interstage combustion chamber by injecting air at point 24 to cause combustion of some of the process stream components. In normal operation an interstage heater 26 was used to reheat the process stream to about 1000–1050 F., in place of injecting air.

Table I below shows a comparison of the operation of the dehydrocyclization process with an interstage heater (Run 1) and without an interstage heater but with injected air (Runs 2, 3, 4, 5) (energy is added by combustion). Without the use of an interstage heater as in the present invention, the conversion to aromatics improved with the amount of air injection within the limits tested.

TABLE I

A Comparison of Conventional Steam-Active Dehydrocyclization and Present Invention

| | With Interstage Heater | No Interstage Heater | | | |
|---|---|---|---|---|---|
| Run No. | 1 | 2 | 3 | 4 | 5 |
| Air injection (moles/mole hydrocarbon feed) | 0.0 | 0.0 | 0.48 | 0.65 | 0.74 |
| $C_6$'s Conversion, mol percent | 23.2 | —[1] | 3.2 | 5.8 | 9.5 |
| $C_7$'s Conversion, mol percent | 51.9 | 30.1 | 38.0 | 40.2 | 41.2 |

TABLE I-continued

A Comparison of Conventional Steam-Active Dehydrocyclization and Present Invention

| | With Interstage Heater | No Interstage Heater | | | |
|---|---|---|---|---|---|
| Run No. | 1 | 2 | 3 | 4 | 5 |
| $C_8$'s Conversion, mol percent | 56.0 | 39.5 | 48.3 | 48.3 | 48.5 |
| $C_9$'s Conversion, mol percent | 58.3 | 56.7 | 63.2 | 61.8 | 62.6 |

[1]There was a net production of n-hexane and n-hexenes from cracking of heavier feed components.

Table II summarizes reaction conditions and product analyses for these runs with varying amounts of air injected into the reactor system.

TABLE II

| Run No. | 2 | 3 | 4 | 5 |
|---|---|---|---|---|
| *Moles air/mole feed | 0 | 0.48 | 0.65 | 0.74 |
| Feed Rate, LHSV | 2.07 | 2.06 | 2.04 | 2.02 |
| Steam/HC | 7.55 | 7.88 | 8.29 | 8.17 |
| $H_2$/HC | 0.49 | 0.49 | 0.49 | 0.50 |
| $P_{in}$, first Reactor | 51 | 51 | 51 | 51 |
| $P_{out}$, second Reactor | 50 | 50 | 50 | 50 |
| Off gas, SCFH | 18.3 | 25.6 | 27.3 | 28.5 |
| $Temp_{in}$, first Reactor | 1120 | 1116 | 1118 | 1120 |
| $Temp_{out}$, first Reactor | 928 | 911 | 924 | 929 |
| $Temp_{in}$, second Reactor | 910 | 978 | 1001 | 1022 |
| $Temp_{out}$, second Reactor | 907 | 932 | 946 | 962 |
| Liquid Analyses (weight percent) | | | | |
| Non-Normal $C_6$'s and Lighter | 1.211 | 1.160 | 1.410 | 1.172 |
| n-Hexane | 10.410 | 8.672 | 7.990 | 7.552 |
| Non-Normal $C_7$'s and Lighter | 4.999 | 5.212 | 5.469 | 5.362 |
| n-Heptane | 19.808 | 18.162 | 17.107 | 17.015 |
| Non-Normal $C_7$ and $C_8$ | 15.820 | 18.196 | 18.636 | 18.728 |
| n-Octane | 15.087 | 12.731 | 12.300 | 13.088 |
| Non-Normal $C_8$ and $C_9$ | 23.314 | 26.928 | 27.390 | 27.885 |
| N-Nonene | 2.318 | 1.566 | 1.775 | 1.748 |
| Non-Normal $C_9$ and Heavier | 7.024 | 7.372 | 7.885 | 7.420 |
| Total Aromatics ($C_6$–$C_9$) | 41.718 | 48.843 | 50.232 | 52.060 |

*Injected between reactors at point 24 of FIG. 1. Feed contained paraffinic hydrocarbons as described above.

These data show that the total yield of aromatics increased as the amount of air injected was increased. Evidence of combustion was indicated by the increasing inlet temperature of the second reactor with an increasing air/feed ratio. Since the reactions which are occurring are very endothermic, the benefit of higher conversion and higher aromatics production with increasing air is quite evident. These data do not necessarily include the optimum air/feed ratio; in fact the optimum may be significantly higher than the highest value shown, depending upon other conditions.

EXAMPLE II

Table III shows the feed components used in the experiments. The average molecular weight of the feed, as can be determined from these components and their quantities is 106.47.

TABLE III

| Component | mol. wt | wt. (gm) | moles |
|---|---|---|---|
| non-normal $C_6$ and lighter | 86.17 | 0.334 | 0.0039 |
| n-$C_6$ | 86.17 | 10.447 | 0.1212 |
| non-normal $C_7$ and lighter | 100.20 | 0.588 | 0.0059 |
| n-$C_7$ | 100.20 | 34.348 | 0.3428 |
| non-normal $C_7$–$C_8$ | 107.0 | 2.278 | 0.0213 |
| n-$C_8$ | 114.22 | 39.489 | 0.3457 |
| non-normal $C_8$–$C_9$ | 125.00 | 4.149 | 0.0332 |
| n-$C_9$ | 128.25 | 8.251 | 0.0643 |
| non-normal $C_9$ and heavier | 128.15 | 0.113 | 0.0009 |
| | | 99.997 | 0.9392 |

Since about 95 percent of the feed is made up of paraffins, its empirical formula may be expressed as $C_nH_{2n+2}$, where n can be determined by $$12n+(2n+2)(1.00)=106.47$$

or n=7.46

For run No. 4 in Table II, 0.74 moles of air (0.1554 moles $O_2$+0.585 moles $N_2$) was used for each mole of feed. Theoretically, (assuming the feed is combusted with the air), 0.0133 moles of feed would be consumed by combustion with air:

$$0.0133(C_{7.46}+H_{16.92})+0.1554O_2+0.585N_2 \rightarrow 0.0992\text{-}2CO_2+0.1125H_2O+0.585N_2.$$

According to this equation, for every 16.38 grams (0.585 $N_2$=0.585×28=16.38) weight increase of $N_2$ in the offgas there should be a corresponding $CO_2$ weight increase of 4.366 grams (0.09922 $CO_2$=0.09922×44=4.366) in the off gas when 0.74 mole of air is used per mole of feed. In one experiment using the above air to feed ratio the off gas analysis showed an increase of 75.789 grams of nitrogen and an increase of 22.662 grams of carbon dioxide compared to the control run using zero air. The "theoretical" $CO_2$ increase according to the above formula should be only 20.2 grams during the 30 minute run [(75.789)/(16.36)×4.366=20.2], which is more than 10 percent less than the experimental value. This indicates that over 10 percent of the "fuel" used in the process is coke. This is another significant advantage of using air in the process, as coke is removed by combustion and contributes heat to the endothermic reaction.

While this invention has been described in detail for the purpose of illustration, it is not to be construed as limited thereby, but is intended to cover all the changes and modifications within the spirit and scope thereof.

What is claimed is:

1. A process for the dehydrocyclization of hydrocarbons comprising the steps of contacting a feed stream, which comprises steam and at least one hydrocarbon selected from the group consisting of normal alkanes and isoalkanes containing 6–12 carbon atoms per molecule, with at least one bed of dehydrocyclization catalyst comprising at least one Group VIII metal and at least one support material selected from the group consisting of Group IIA and Group IIB metal aluminate spinels thus forming a reaction mixture, and heating said reaction mixture under such reaction conditions as to produce aromatic hydrocarbons containing from 6 to 12 carbon atoms per molecule, wherein a free oxygen containing gas is injected into said reaction mixture in at least one location downstream of the point where said feed stream is first contacted with said bed of catalyst and the mol ratio of injected oxygen to the hydrocarbon feed is in the range of from about 40:100 to about 200:100.

2. A process in accordance with claim 1, wherein at least two beds of dehydrocyclization catalyst in series are employed and the free oxygen containing gas is introduced into a conduit connecting said at least two beds.

3. A process in accordance with claim 1, wherein the catalyst further comprises a Group IVA metal.

4. A process in accordance with claim 3, wherein the catalyst comprises platinum, tin and zinc aluminate.

5. A process in accordance with claim 4, wherein the amount of platinum in said catalyst ranges from about 0.1 to about 5 weight percent and the amount of tin ranges from about 0.1 to about 2 weight-percent, based on the weight of the entire catalyst.

6. A process in accordance with claim 1, wherein said reaction conditions comprise a temperature ranging from about 900° F. to about 1100° F.

7. A process in accordance with claim 6, wherein the mol ratio of steam to the hydrocarbon feed ranges from about 200:100 to about 1000:100.

8. A process in accordance with claim 7, wherein the mol ratio of steam to said hydrocarbon feed ranges from about 300:100 to about 1000:100.

9. A process in accordance with claim 7, wherein the mol ratio of said injected oxygen to said hydrocarbon feed ranges from about 40:100 to about 100:100 and the mol ratio of steam to the hydrocarbon feed ranges from about 500:100 to about 1000:100.

10. A process according to claim 3, wherein said at least one hydrocarbon is selected from the group consisting of n-alkanes and isoalkanes containing 6–9 carbon atoms per molecule.

11. A process in accordance with claim 10, wherein said reaction conditions comprise a temperature ranging from about 900° F. to about 1100° F.

12. A process in accordance with claim 11, wherein the mol ratio of steam to said hydrocarbon feed ranges from about 200:100 to about 1000:100.

13. A process in accordance with claim 12, wherein the mol ratio of steam to said hydrocarbon feed ranges from about 300:100 to about 1000:100.

14. A process in accordance with claim 13, wherein the mol ratio of said injected oxygen to said hydrocarbon feed ranges from about 40:100 to about 100:100 and the mol ratio of steam to the hydrocarbon feed ranges from about 500:100 to about 1000:100.

15. A process in accordance with claim 8, wherein free hydrogen is introduced with said hydrocarbon feed and the mol ratio of hydrogen to said hydrocarbon feed ranges from about 50:100 to about 200:100.

16. A process in accordance with claim 8, wherein the mol ratio of hydrogen to said hydrocarbon feed ranges from about 100:100 to about 200:100.

17. A process in accordance with claim 11, wherein free hydrogen is introduced with said hydrocarbon feed and the mol ratio of hydrogen to said hydrocarbon feed ranges from about 50:100 to about 200:100.

18. A process in accordance with claim 1, wherein the oxygen containing gas is air.

19. A process in accordance with claim 10, wherein the oxygen containing gas is air.

20. A process in accordance with claim 1 wherein said free oxygen gas is injected into at least one bed of catalyst at a plurality of injection points located downstream of the first point of contact of said feed stream and said catalyst.

* * * * *